United States Patent [19]

Newton et al.

[11] 4,414,465

[45] Nov. 8, 1983

[54] COOKING APPARATUS

[75] Inventors: Stephen J. Newton, Haslemere; Abdul H. Patel, Fareham, both of England

[73] Assignee: Thorn Domestic Appliances (Electrical) Ltd., London, England

[21] Appl. No.: 240,324

[22] Filed: Mar. 4, 1981

[30] Foreign Application Priority Data

Mar. 5, 1980 [GB] United Kingdom ..... 8007544
Aug. 4, 1980 [GB] United Kingdom ..... 8025339

[51] Int. Cl.[3] ..... H05B 3/68

[52] U.S. Cl. ..... 219/449; 219/347; 219/405; 219/461; 219/464; 219/510

[58] Field of Search ..... 219/405, 411, 449, 452, 219/450, 459, 460, 461, 462, 463, 464, 510, 512, 347, 349, 363, 364

[56] References Cited

U.S. PATENT DOCUMENTS

| | | | |
|---|---|---|---|
| 3,710,076 | 1/1973 | Frazier | 219/449 |
| 3,883,719 | 5/1975 | Hurko | 219/264 |
| 4,161,648 | 7/1979 | Goessler | 219/464 |
| 4,243,874 | 1/1981 | Fischer | 219/449 X |
| 4,327,280 | 4/1982 | McWilliams | 219/464 |

FOREIGN PATENT DOCUMENTS

| | | |
|---|---|---|
| 687647 | 11/1940 | Fed. Rep. of Germany . |
| 7405641 | 2/1974 | Fed. Rep. of Germany . |
| 2444753 | 4/1976 | Fed. Rep. of Germany . |
| 2608295 | 9/1977 | Fed. Rep. of Germany . |
| 2620004 | 1/1978 | Fed. Rep. of Germany . |
| 7930529 | 2/1980 | Fed. Rep. of Germany . |
| 764341 | 12/1956 | United Kingdom . |
| 953361 | 3/1961 | United Kingdom . |
| 1406028 | 9/1976 | United Kingdom . |
| 2003005 | 2/1979 | United Kingdom . |
| 1552178 | 12/1979 | United Kingdom . |
| 1562251 | 3/1980 | United Kingdom . |
| 2072887 | 10/1981 | United Kingdom . |

*Primary Examiner*—Volodymyr Y. Mayewsky
*Attorney, Agent, or Firm*—Fleit, Jacobson, Cohn & Price

[57] ABSTRACT

An electric cooker or cooking hob has a ceramic plate 2 on which there are a number of hot plate areas each heated by a respective annular heating element 4 disposed within an insulating housing 7. A temperature dependent resistor 9 is disposed below the hot plate area at the center of focus of a reflector 8 which is arranged to focus radiant energy from the hot plate area onto the resistor 9 while at the same time shielding the resistor 9 from direct radiation from the electric heating element 4. The signal derived from the resistor 9 is a measure of the temperature of the hot plate and can be used to provide a thermal tripping function to prevent overheating of the hot plate area and/or to carry out closed loop control of the temperature of the hot plate area. The reflector 8 may be replaced by a shield which shields the resistor 9 from direct heating by the heater.

A further annular heating element surrounding the element 4 may be provided, with the control circuitry enabling either the element 4 alone or element 4 plus the outer element to be energized.

8 Claims, 8 Drawing Figures

COOKING APPARATUS

The present invention relates to cooking apparatus.

Electric cookers and cooking hobs are known which have a ceramic plate upon which is defined one or more heating areas having associated therewith an electric heating element disposed below the ceramic plate and arranged to heat the plate by means of radiant energy. It is desirable to know the temperature of the ceramic plate, both so as to prevent over-heating of the plate and to provide closed-loop temperature control. While it is possible to bond temperature responsive elements to the underside of the plate, or embed them in it, neither of these solutions is entirely satisfactory.

According to the present invention there is provided a cooking apparatus comprising: a hot plate; at least one heater for heating the hot plate, the heater being disposed below the hot plate; at least one temperature responsive element below the hot plate and being separated therefrom by a gap and being arranged so as, in use, to receive heat energy across said gap so as to produce an electrical signal which will track the temperature of the underside of the hot plate; and control circuitry for controlling the heater in dependence upon the output of the at least one temperature responsive element.

In one embodiment described below with reference to the accompanying drawings, which may be applied to an electric cooker or cooking hob, the hot plate is an area defined by markings or ridges on the upper surface of a ceramic plate and the heater is an annular electric heating element disposed in an open-topped insulating housing below the ceramic plate. Associated with the heating element is a burst-fire controller to control the energisation of the heating element in dependence upon the setting of a user-operable control. The temperature responsive element is suitably a temperature dependent resistor such as a platinum-wire resistor and this is suitably disposed at the centre of the heating element and supported by the insulating housing. The reflector serves both to focus radiant energy from the hot plate onto the temperature dependent resistor and to shield the resistor from direct radiation from the heating element. A signal derived from the resistor may be used both to exercise a thermal tripping function to prevent overheating of the plate and/or to carry out closed-loop temperature control of the hot plate.

In one form, the temperature responsive element may be disposed at the focus of a reflector which serves to concentrate the radiant energy from the underside of the hot plate onto the element and to shield the element from direct heating by the heater. However, it has been found by experiment that when such a reflector is omitted there is a good enough correlation between the temperature detected by the element and pan temperature to enable the reflector to be omitted in practical operation. A shield may still be provided, if desired, to shield the element from direct heating by the heater.

In one embodiment described below with reference to the drawings, the heating element is disposed below the hot plate and the temperature sensor is disposed within a cylindrical shield also below the hot plate and arranged to shield the sensor and the above mentioned part of the hot plate area from direct heating by the heater. The sensor is connected to circuitry arranged to respond to the output of the sensor and a user-operable temperature setting control and to carry out closed-loop control of the temperature of the pan or utensil on the hot plate.

The temperature responsive element may be disposed within a shield which also shields a portion of the hot-plate from direct heating by the heater. The element can then be used to measure the temperature of said portion and hence indirectly of any pan, etc., placed over this portion.

A further temperature sensor may be provided to exercise a thermal tripping function to prevent over-heating of the hot plate under no-load conditions.

Optionally a further heater may be provided around the first heater and arranged to heat an outer area of the hot plate at least partly surrounding the area heated by the first element. Thus, by energising only the first heater when only a relatively small pan is being heated, unnecessary wastage of heat is avoided. To accommodate larger pans the outer heater can be energised also.

The invention further provides cooking apparatus comprising a hot plate, at least one heater for heating the hot plate, at least one temperature responsive element disposed so that the heat energy which in use it receives is primarily radiant energy from the hot plate and being arranged to produce an electrical signal dependent on the temperature of the hot plate, and control circuitry for controlling the heater in dependence upon the output of the at least one temperature responsive element.

The invention will be further described with reference to the accompanying drawings in which.

Figure 1:
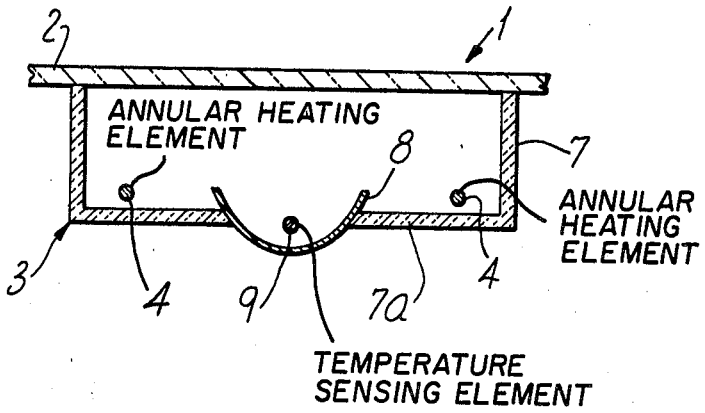
FIG. 1 is a simplified sectional view through the hot plate of one embodiment of the present invention.
Figure 2:
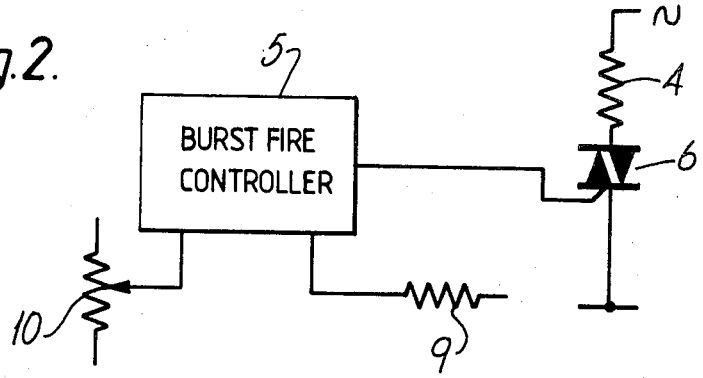
FIG. 2 is a block schematic circuit diagram of the embodiment of FIG. 1.

The ceramic cooking hob, of which part is shown in FIG. 1, comprises an upper ceramic or glass plate 2 on which are defined, by ridges or markings, a number of hot plate areas. Below each of these areas is disposed a respective heater assembly as indicated at 3. Each heater assembly comprises an annular heating element 4, the energisation of which is controlled by means of a burst fire controller 5 (see FIG. 2) which delivers gating pulses to a triac 6 connected in series with the heating element 4 across the electrical mains supply. Also associated with the heating element 4 is a user-operable control, namely a potentiometer 10, to enable the user to set the desired temperature of the associated hot plate area. As is well known, the burst fire controller 5 can operate either to carry out open-loop or closed-loop control of the hot plate temperature.

The principle of operation of burst fire controllers is well known; in one simple form, the voltage picked off at the wiper of the potentiometer 10 is applied, together with a ramp waveform having a time period of several seconds to a comparator (not shown). The comparator is arranged so that the triac 6 has a gating signal applied to it for that part of each cycle of the ramp when the ramp voltage is less than the voltage from the potentiometer. When this relationship is reversed, the gating signal is removed so that, once the triac 6 has turned off at the end of a half-cycle of the mains supply wave form, it remains off for the remainder of the ramp cycle.

As indicated in FIG. 1, the heating element 4 is mounted in an open-topped insulating housing 7. At the centre of the bottom wall 7*a* of the insulating housing, there is disposed a parabolic or other suitable shaped metallic reflector 8 which is shaped and dimensioned so that the heat energy radiated downwards from the underside of the hot plate area which is heated by the element 4 is focused on a temperature sensing element 9 disposed within the reflector 8 and whose resistance varies continuously with temperature. Preferably, the element 9 is a platinum wire resistor although any other type of temperature dependent resistor, such as a thermistor, may be used. Alternatively, a thermocouple may be used. In the following the element 9 will be assumed to be a platinum wire resistor (as shown by element 9 in FIG. 2).

As the resistance of the platinum resistor varies with temperature, and as the heat energy which resistor 9 receives is primarily radiant energy from the hot plate (although some energy will also be transferred by convection), the resistance of resistor 9 is dependent upon the temperature of the undersurface of the hot plate area. In this and the following embodiments of the invention, element 9 is separated from the hot plate by an air gap across which it receives heat energy from the hot plate.

The reflector 8 is suitably disposed relative to the heating element 4 so that it is shielded from, and thus receives no direct radiation from, the heating element 4. Furthermore, the spacing of the heating element 4 from the reflector helps to isolate the resistor 9 from the direct influence of the heating element 4.

A signal representing the temperature of the undersurface of the hot plate area can be derived from the resistance of the platinum resistor 9. This signal may be produced, for example, by applying a known voltage across the resistor 9 and measuring the current passing through it, or by passing known current through it and measuring the voltage thus developed. The signal thus derived may be used for control and/or thermal tripping functions. The ceramic hot plate can be damaged by excessive heating and, in order to avoid this, the temperature signal from the resistor 9 can be compared with a reference signal representing a desired maximum temperature of the ceramic and thus used to disable the burst fire controller, so turning off the heating element 4, until the temperature of the ceramic has returned to a safe level.

As well as the thermal tripping function, the signal derived from the resistor 9 can, as well or instead, be used for closed-loop temperature control. This can be achieved by forming an error signal by applying the set-point temperature signal from the potentiometer 10 and the signal from the resistor 9 to a differential amplifier (not specifically shown but contained within burst fire controller 5 of FIG. 2); it is then this error signal which is compared by the comparator (in burst fire controller 5) with the ramp voltage to determine the mark-to-space ratio of the energisation of the heating element 4.

In our copending British Application No. 2072887A we describe a cooking apparatus in which the temperature of the heating element is measured by sampling the resistance of the heating element during the "spaces" of its burst fired energisation. It would, of course, be possible to incorporate the present invention in such an apparatus so that the resistor 9 could be used to provide a thermal tripping function to protect the ceramic plate 2, and the resistance of the heating element 4 would be used to derive a signal for closed-loop control of the heating element temperature; alternatively, the resistor 9 could be used for closed-loop temperature control of the hot plate area of the ceramic plate, and the resistance of the heating element 4 would be used for a thermal tripping function.

Numerous variations of the above described apparatus will be apparent. For example, the reflector 8 could be omitted and the temperature sensor 9 could be embedded in, or located, in a recess in, the floor 7*a* of the insulating housing in such a manner that it could directly receive radiation from the ceramic plate 2 but at the same time be shielded from direct radiation from the element 4.

Figure 3:
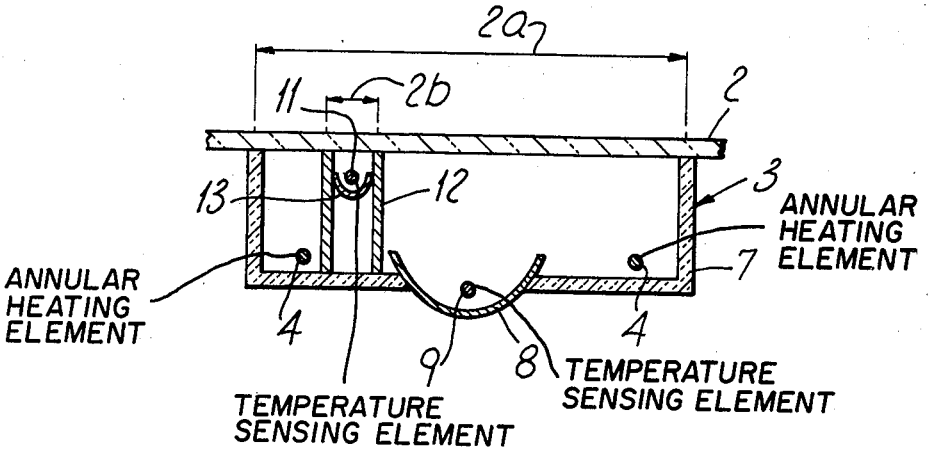
FIG. 3 is a view corresponding to FIG. 1 of a second embodiment of the invention.

FIG. 3 shows part of a second form of a cooking hob embodying the present invention in which, in addition to the temperature sensing resistor 9, there is provided a further temperature sensing element 11, which may be of the same type as resistor 9, i.e. preferably a platinum wire resistor. This resistor 11 is disposed below the hot plate 2 within a cylindrical shield 12 of suitable material, which cylindrical shield 12 serves to shield resistor 11 and a part 2*b* of the hot plate area 2*a* of the hot plate 2 from direct heating by the heating element 4, so that the resistor 11 is heated primarily by radiant energy from the part 2*b*. The area 2*b* is circular and offset with respect to the centre of area 2*a*. When a pan is placed on the hot plate area 2*a* it is heated and in turn heats the area 2*b*. As area 2*b* is shielded from heater 4, its temperature correlates with the temperature of the pan, and thus, by monitoring the temperature of area 2*b* the temperature sensor 11 can produce a signal representative of the pan temperature.

Figure 4:
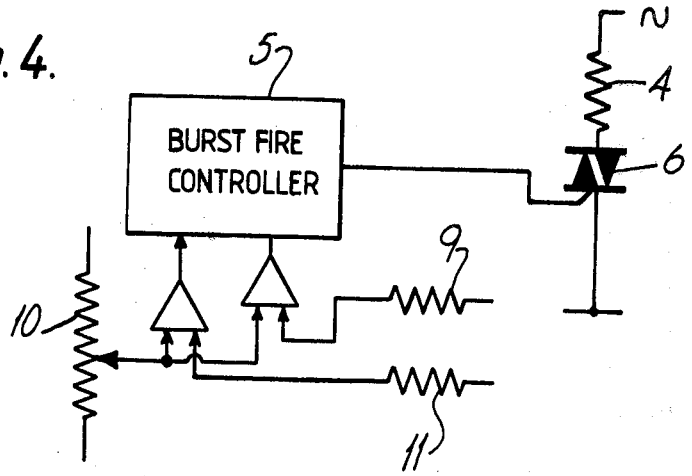
FIG. 4 is a block schematic circuit diagram of the embodiment of FIG. 3.

As in the case of sensor 9, sensor 11 may alternatively be a thermocouple or temperature dependent resistor, and may have associated with it a metallic reflector 13 of parabolic or other suitable shape to improve the correlation with pan temperature. A burst fire controller 5 shown in FIG. 4 operates in such a manner as to carry out closed-loop control of the pan temperature in dependence upon the desired temperature as set by the potentiometer 10 and the actual temperature. as detected by sensor 11. Signals indicative of the desired and actual temperatures are applied to a differential amplifier 14, an output of which is then fed to the burst fire controller 5.

In this embodiment, the other resistor 9 is used to derive a signal representing the temperature of the hot plate for thermal tripping purposes so that the controller 5 shuts down the heater 4 in the event of overheating of the hot plate. The signal from resistor 9 and a signal from potentiometer 10 are compared by a comparator 15, an output of which is also fed to the burse fire controller 5, to provide control thereof.

Various other forms of thermal tripping may be provided instead of resistor 9; for example, a conventional bimetallic trip can be employed, or sampling of the resistance of the heating element as described above can be used.

The area 2*b* may, of course, be concentric with the area 2*a*.

Figure 5:
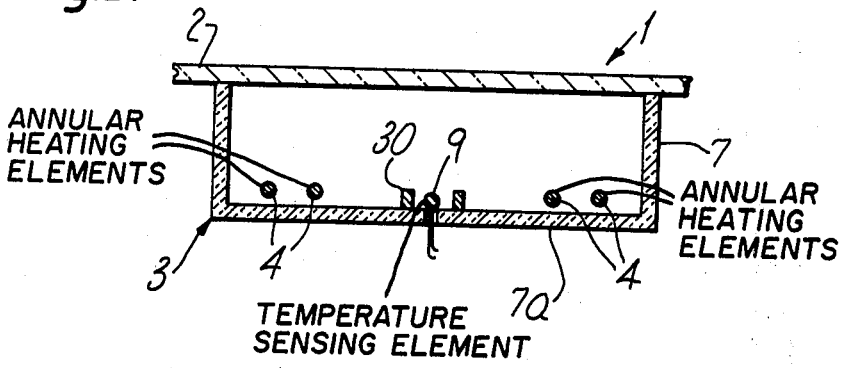
FIGS. 5 and 6 are sectional views of variants of hot plates of FIGS. 1 and 3 respectively.
Figure 6:
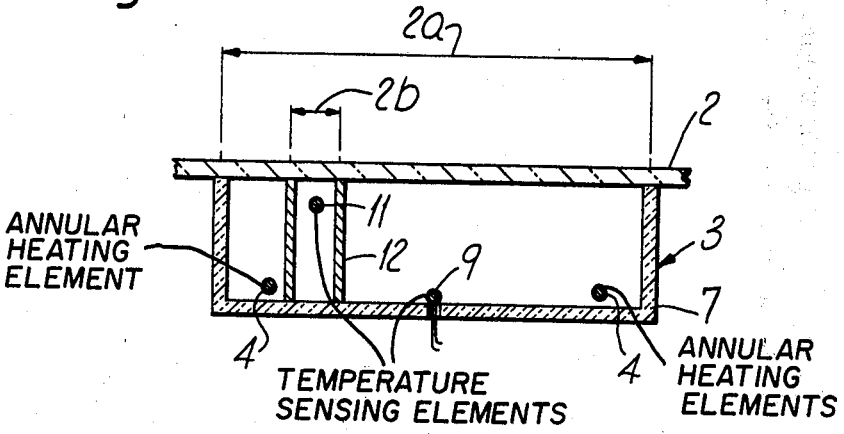

FIGS. 5 and 6 show variants of the embodiments of FIGS. 1 and 3, respectively, in which the shield surrounding the resistor 9 (and 11, where provided), has been omitted.

In the embodiments of FIGS. 5 and 6, the resistor 9 is heated primarily by radiation and convection by the hot underside of the hot plate 2, in FIG. 5, the resistor 9 being shielded by the wall 30. We have quite surprisingly found that, with a heater and housing arrangement generally as shown in FIG. 5, the wall 30 may be omitted and the output signal from resistor 9 will still track the temperature of the hot plate 2 sufficiently closely and rapidly as to enable effective closed loop control of the hot plate temperature to be carried out. Indeed, we have found that by using an approximately cylindrical resistor 9, good control can be achieved by having the resistor 9 arranged vertically so that more of its surface can "see" the heating element and thus be directly heated by it, such being in contrast to the case in the illustrated embodiments where resistor 9 is horizontally disposed. Having the resistor 9 vertical means that, during the initial warm-up period when the heater 4 is first turned on, the resistor 9 is heated primarily by heat energy directly from the heater 4, so that it heats more rapidly than if it were to be heated only by indirect heating via the hot plate 2; as the hot plate 2 approaches working temperature, its contribution to the heating of resistor 9 becomes proportionately greater, so enabling the output of the resistor 9 to track the hot plate temperature well enough to enable closed loop hot plate temperature control to be carried out.

Figure 7:
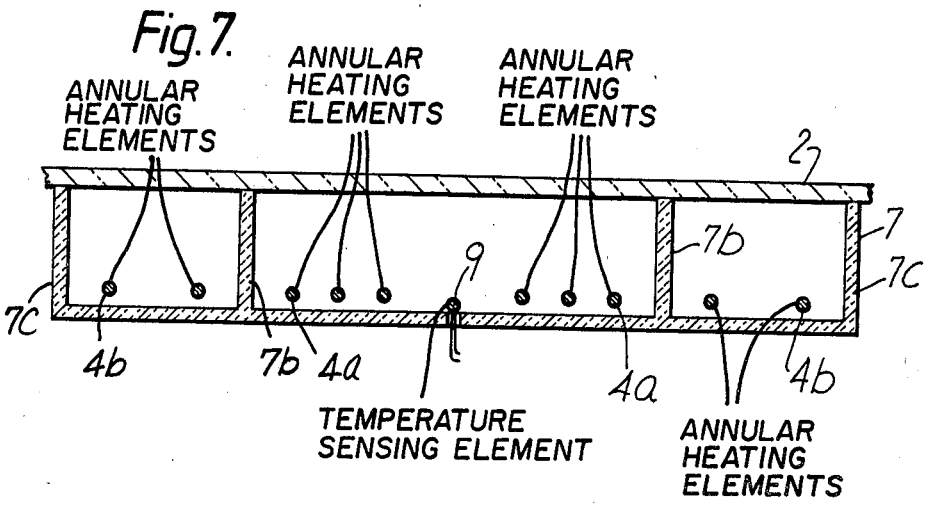
FIG. 7 is a sectional view of the hot plate of a third embodiment of the invention.

FIG. 7 shows the hot plate of a further embodiment of the invention in which the area of the hot plate which is heated can be selected by the user. In this embodiment, the housing 7 of the heater assembly is divided into two concentric compartments by means of an inner cylindrical partition 7*b*. The heater 4 is in two part form, one of part, 4*a*, being disposed within the central area bounded by the partition 7*b* and the second part, 4*b*, being located between the partition 7*b* and the outer wall 7*c* of the housing.

The controller 5 (FIG. 8) is provided with a user-operable switch 20 by means of which the user can select the permutation of heating elements which are energised. In one position of the switch 20, only the central heating element 4*a* is energised while, in a second position, both the element 4*a* and the element 4*b* are energised. The first position would be appropriate where only a small pan was to be heated or a large pan at a relatively low heat setting. The second position would be used to heat larger pans.

Figure 8:
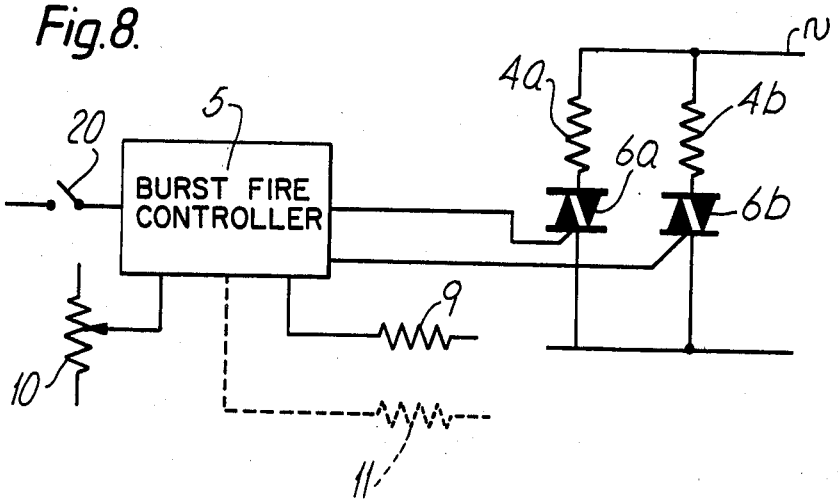
FIG. 8 is a block schematic circuit diagram of the embodiment of FIG. 7.

As shown in FIG. 8, the heating elements 4*a* and 4*b* have respective triacs 6*a* and 6*b* associated with them. The temperature sensing resistor 9 monitors the hot plate temperature for the part of the hot plate within the area defined by the partition 7*b*. This means that closed-loop temperature control of the element 4*a* is carried out in dependence upon the setting of the user control potentiometer 10. When the switch 20 is in the position in which both elements are energised, the controller carries out closed-loop control of the operation of the heating element 4*a* and open-loop control of the element 4*b*.

Alternatively, the element 4*b* could be operated under the control of a separate temperature sensing element. Equally, both elements 4*a* and 4*b* may have a common thermal trip or have separate ones.

We claim:

1. Cooking apparatus including: a glass ceramic hot plate; at least one heater for heating the hot plate disposed within an open-topped insulated housing below the hot plate; and a temperature responsive element spaced from the hot plate by a gap, and disposed, in use, to receive heat energy across the gap directly from the hot plate, so that the heat energy it receives is primarily radiant energy directly from the hot plate, and to produce a first electrical signal indicative of the temperature sensed thereby; the cooking apparatus also including a further temperature responsive element sensing the temperature of an area of the hot plate shielded from direct heating by the heater and to produce a second electrical signal indicative of the sensed temperature; and control circuitry wherein the first signal is used for maximum temperature cut-out and the second signal is used for closed loop control of the heater.

2. Cooking apparatus as claimed in claim 1 wherein the housing includes a floor spaced from the hot plate and the first-mentioned temperature responsive element is mounted on the floor of the housing.

3. Cooking apparatus as claimed in claim 1 wherein the further temperature responsive element is disposed below the hot plate within a shield that shields both it and said area of the hot plate from direct heating by the heater.

4. Cooking apparatus as claimed in claim 1, wherein the first-mentioned temperature responsive element is arranged so that, in a period following initial turn-on of the heater, it is heated predominantly by energy direct from the heater.

5. Cooking apparatus as claimed in claim 1 wherein the first-mentioned temperature responsive element has a reflector associated therewith, the reflector being arranged to focus radiant energy from the hot plate towards the first-mentioned temperature responsive element and to shield it from direct heat energy from the heater.

6. Cooking apparatus as claimed in claim 1 wherein the further temperature responsive element has a reflector associated therewith, the reflector being arranged to focus radiant energy from said area of the hot plate towards the further temperature responsive element.

7. Cooking apparatus as claimed in claim 1 wherein the temperature sensed by the further temperature responsive element is substantially that of a pan disposed upon the hot plate and being heated by the heater.

8. Cooking apparatus as claimed in claim 1 wherein at least one of the temperature responsive elements consists of a platinum wire resistor.

* * * * *